US005184683A

United States Patent [19]

Takamasa

[11] Patent Number: 5,184,683

[45] Date of Patent: Feb. 9, 1993

[54] SPRINKLER HEAD

[76] Inventor: Hattori Takamasa, 218-315 Ogaito Oaza Kumatori-cho Sennan-gun, Osaka-fu, Japan

[21] Appl. No.: 719,155

[22] Filed: Jun. 21, 1991

[30] Foreign Application Priority Data

Mar. 6, 1991 [JP] Japan ..... 3-39278[U]
Mar. 6. 1991 [JP] Japan ..... 3-39279[U]

[51] Int. Cl.[5] ..... A62C 37/08
[52] U.S. Cl. ..... 169/37; 251/66
[58] Field of Search ..... 169/19, 37, 38, 39, 169/40, 41, 42; 251/66, 337

[56] References Cited

U.S. PATENT DOCUMENTS 4,465,141 8/1984 Johnson ..... 169/37
4,508,175 4/1985 Pieczykolan ..... 169/38
4,618,002 10/1986 Mears ..... 169/37
4,715,447 12/1987 Johnson ..... 169/37
5,094,298 3/1992 Polan ..... 169/37 X

*Primary Examiner*—Johnny D. Cherry
*Assistant Examiner*—Andrew C. Pike
*Attorney, Agent, or Firm*—Koda and Androlia

[57] ABSTRACT

A sprinkler head wherein an engagement face for engagement by a locking member is formed on the inner surface of an inwardly raised portion of a frame, and locking protrusions are formed on the upper and lower sides of the engagement face for preventing disengagement of the locking member from the engagement face, in order to ensure accurate and positive locking engagement of the locking member, and wherein an elastic member is interposed between the lower end of a sprinkler head body and the plug member, with a screw member being put in thread engagement with the inner periphery of the plug member, so that by threaded disengagement of the screw member from the plug member the plug member is allowed to shift toward an outlet port, whereby the elastic member is tensioned under a predetermined pressing force to enable the plug member to effect satisfactory descending movement.

6 Claims, 8 Drawing Sheets

SPRINKLER HEAD

FIELD OF THE INVENTION

The present invention relates generally to sprinkler heads and, more particularly, to improvements in sprinkler heads for discharge of fire-fighting water supply in the event of a fire.

BACKGROUND OF THE INVENTION

Sprinkler heads of this type have been known. A typical example is described in the specification of U.S. Pat. No. 4,618,002.

According to this prior art arrangement, as FIG. 9 shows, in order to stop the outlet port 4 of the sprinkler head body 1, there are disposed, under the plug member 29, a pair of holder members, upper and lower, 31, 32, between which a partially cutaway ring-shaped locking member 11 is held in expanded condition, partially exposed outside, under the clamping force of a screw member 30, and a washer-like spring 33 for upwardly biasing the plug member 29 is interposed between the upper holder member 31 and the plug member 29.

The pair of holder members 31, 32 are fixed in position by putting the locking member 11 held in expanded condition between the holder members 31, 32 into engagement with an upper tapered surface 36 of an inwardly raised portion 35 formed on the lower inner peripheral edge of the frame 34.

In the event of a fire or the like, the heat-meltable member 22 interposed between the collar portion 30*a* of the screw member 30 and the lower holder member 32 becomes melted to reduce the holding ability of the holder members 31, 32 with respect to the locking member 11, so that the locking member 11 is contracted under its own restoring force. As a consequence, the engagement between the locking member 11 and the inwardly raised portion 35 is removed; the holder members 31, 32 and the plug member 29 fall off the sprinkler head body 1; and thus sprinkling of fire-fighting supply water can be performed properly.

However, this prior art arrangement is disadvantageous in that since the locking member 11 is held in locking position by means of the pair of holder members 31, 32 and the tapered surface 36 of the inwardly raised portion 35 of the frame 34, when an external impact is applied to the sprinkler head, the locking member 11 is likely to shift along the tapered surface 36 of the inwardly raised portion 35 and, therefore, may not be maintained in its locking position, with the result that the plug member 29 or the like may drop untimely to cause fire supply water sprinkling.

Another disadvantage is that the locking member 11 is likely to slip off during the process of sprinkler head assembling, too, and therefore that the prior art sprinkler head is not suitable for production on a so-called automatic assembly line and is thus obliged to be produced through manual assembly operation.

Further, according to this prior art arrangement, when the locking member 11 is relieved of its locking condition, the plug member 29 falls by gravity only. This poses a problem that the plug member 29 does not drop quickly or accurately, and in particular that when the outlet port 4 has been closed by the plug member 29 for long, the dropping of the plug member 29 is apt to be hampered by rust or the like produced on the interface between the plug member 29 and the outlet port 4, which may be taken as a fatal disadvantage.

SUMMARY OF THE INVENTION

Therefore, it is a primary object of the present invention to provide a sprinkler head which will not go into untimely operation when some external impact is applied and will, in case of need, properly operate to perform satisfactory sprinkling, and which can provide for simplified assembly work.

In order to accomplish the foregoing object, according to the invention there is provided a sprinkler head, as shown in FIG. 2, wherein a ring-shaped or partially cutaway ring-shaped expandable and contractable locking member 11 is held in expanded condition between collar portions 12*d*, 13*b* of a pair of holder members 12, 13, upper and lower, and an inwardly raised portion 16 formed on the lower inner peripheral edge of a frame 24 disposed in the body 1 of the sprinkler head so that an outlet port 4 of the sprinkler head body 1 is closed by means of a plug member 3, and so that when a heat-meltable member 22 is melted or softened with heat, the locking member 11 is contracted to permit the holder members 12, 13 to slip off the frame 24 so as to release the plug member 3 from the outlet port 4, characterized in that the inwardly raised portion 16 comprises an engagement face 17 formed on its inner surface for engagement by the locking member 11, and locking protrusions 25*a*, 25*b* formed on upper and lower sides relative to the engagement face 17 to prevent the locking member 11 from slipping off the engagment face 17.

It is possible to arrange that an elastic member 7 is interposed between a lower end portion 1*a* of the sprinkler head body 1 and the plug member 3, and a screw member 19 is held in thread engagement with the inner periphery of the plug member 3, so that by threadingly disengaging said screw member 19 from the plug member 3, the plug member 3 is allowed to shift toward the outlet port 4 so that the elastic member 7 is tensioned under a predetermined pressing force.

In the sprinkler head of the invention, as described above, the engagement face 17 for engagement by the locking member 11 is formed on the inner surface of the inwardly raised portion 16 of the frame 24, and accordingly the locking member 11 in expanded condition is brought in engagement with the engagement face 17. Further, the locking member 11 is locked by the locking protrusions 25*a*, 25*b* formed on upper and lower sides of the engagement face 17. Therefore, the locking member 11 is not liable to be disengaged from the engagement face 17 even if some external impact is applied to the sprinkler head. Thus, the locking member 11 can be positively held between the holder members 12, 13 and the inwardly raised portion 16.

According to the invention, therefore, it is possible to advantageously prevent such a trouble that when some external impact is applied to the sprinkler head, the locking member 11 may be subjected to some positional deviation to cause untimely dropping of the plug member 3 as has often been experienced with the prior art sprinkler head in which the locking member 11 is held in its locking position by the tapered surface of the inwardly raised portion.

The fact that the locking member 11 can be accurately held in position by the holder members 12, 13 and the inwardly raised portion 16 provides for ease of sprinkler head assembly operation and, therefore, enables production of sprinkler heads on an automatic assembly line.

When, in the event of a fire or the like, the heat-meltable member 22 is melted or softened with heat, the locking member 11 is contracted to release the engagement between the locking member 11 and the inwardly raised portion 16 of the frame 24, so that the holder members 12, 13, together with the locking member 11, are allowed to slip off the frame 24.

In this case, with the elastic member 7 interposed, by being tensioned under a predetermined pressing force, between the lower end portion 1*a* of the sprinkler head body 1 and the plug member 3, separation from the outlet port 4, and dropping, of the plug member 3 can be accurately and quickly achieved by the restoring force or resiliency of the elastic member 7.

The separation of the plug member 3 directly results in the sprinkling of fire supply water from the outlet port 4 of the sprinkler head body 1.

The pressing force of the plug member 3 against the elastic member 7 is adjustable by back-and-forth screwing of the screw member 19, and therefore the elastic member 7 may be pressed constantly under an appropriate pressing force by suitably changing the screwed amount of the screw member 19. This assures long-time serviceability of the sprinkler head.

BRIEF DESCRIPTION OF THE DRAWINGS

FIG. 1 (*b* ) is a plan view thereof;

DESCRIPTION OF THE PREFERRED EMBODIMENTS

One embodiment of the invention will now be described with reference to the accompanying drawings.

Figure 1A:
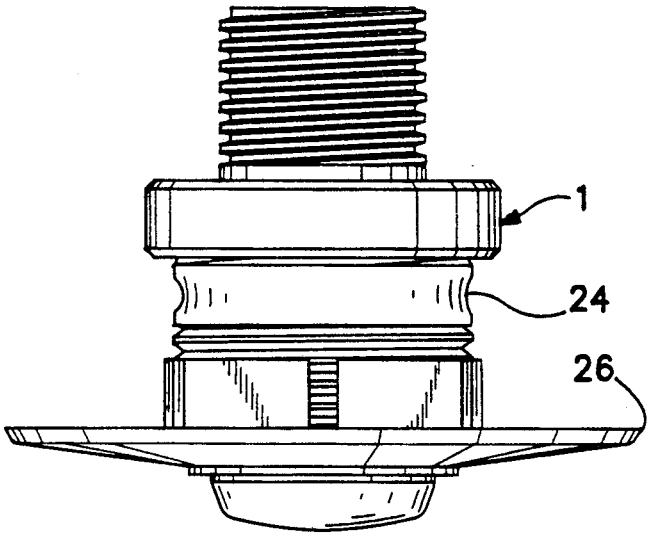
FIG. 1 (*a*) is a front view showing one embodiment of the sprinkler head according to the invention.
Figure 1B:
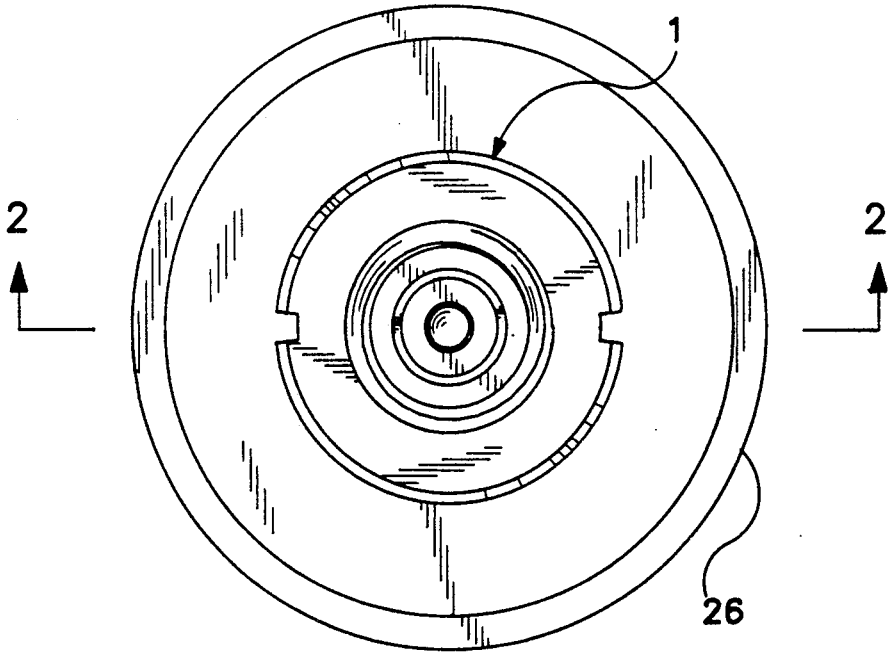
Figure 2:
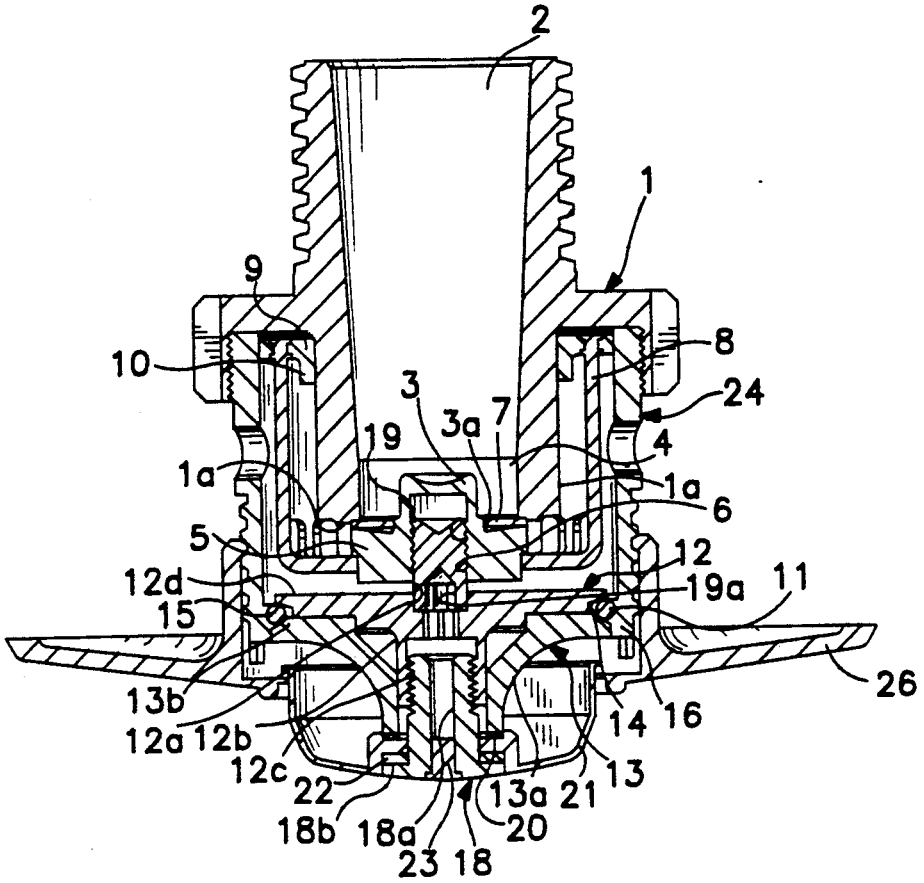
FIG. 2 is a section taken along line 2—2 in FIG. 1 (*b*)

In FIGS. 1(*a*), 1(*b*), and 2, there is shown a sprinkler head including a sprinkler head body 1 having a fire supply water inlet passage 2 formed therein, with a generally cylindrical frame 25 threadedly fixed to a lower peripheral edge portion of the sprinkler head body 1. A plug member 3 for closing an outlet port 4 formed in a lower portion of the sprinkler head body 1 has a collar portion 5 formed around a lower peripheral edge of the plug member 3 and also has an internal threaded portion 6 formed on its inner periphery into which is threadedly received an in-press screw 19. The in-press screw 19 is formed at one end thereof with a hexagonal hole 19*a*. An elastic member 7 consisting of belleville springs having a fluoroplastic coated surface is interposed, while being tensioned under a predetermined pressing force, between a lower end portion 1*a* of the outlet port 4 of the spinkler head body 1 and the upper surface of the collar portion 5 of the plug member 3, the inner periphery of the elastic member 7 being fitted in a recessed groove 3*a* formed in the outer periphery of the plug member 3.

A plurality of bent deflectors 8 are connected to the outer peripheral edge of the plug member 3, each of the deflectors 8 being connected at its upper end to a guide ring 9 slidable relative to the outer periphery of the sprinkler head body 1 and having a downwardly projecting guide portion 10, which serves as a guide when the plug member 3 drops.

Figure 10A:
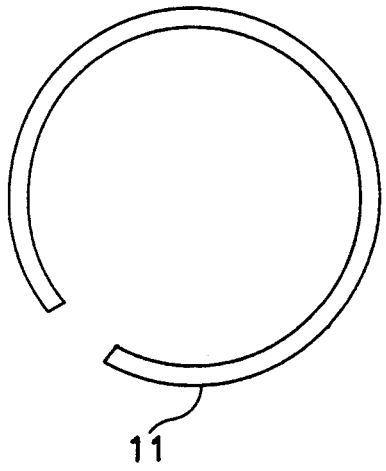
FIGS. 10(*a*) and 10(*b*) show respectively a partially cutaway ring shaped or a ring shaped expandable and contractable locking member.
Figure 10B:
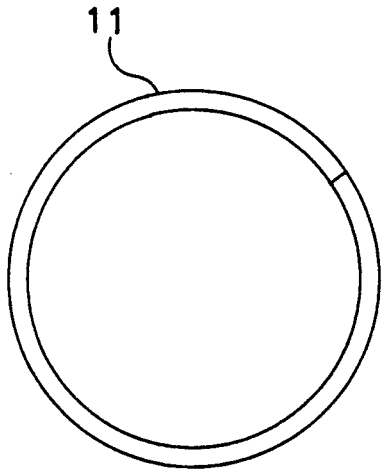

There is provided a partially cutaway ring-shaped (as shown in FIG. 10 (*a*)), elastically deformable locking member 11 which is adapted to diametrically expand and contract. Also, there are provided a pair of holder members 12, 13, upper and lower, for holding the locking member 11 between them. The upper holder member 12 has a hole 12*a* formed in its upper surface which is adapted to receive a lower end portion of the in-press screw 19, and a cylindrical portion 12*b* which is formed on its inner periphery with an internal threaded portion 12*c*. The cylindrical portion 12*b* of the upper holder member 12 is slidably fitted on a cylindrical portion 13*a* of the lower holder member 13. The holder member 12, 13 have respective collar portions 12*d*, 13*b* which are respectively formed on their outer peripheral edge portions with tapered surfaces 14, 15 which are inwardly lesser spaced from each other so that the locking member 11 can be held in expanded condition therebetween as shown in FIG. 3.

Figure 3:
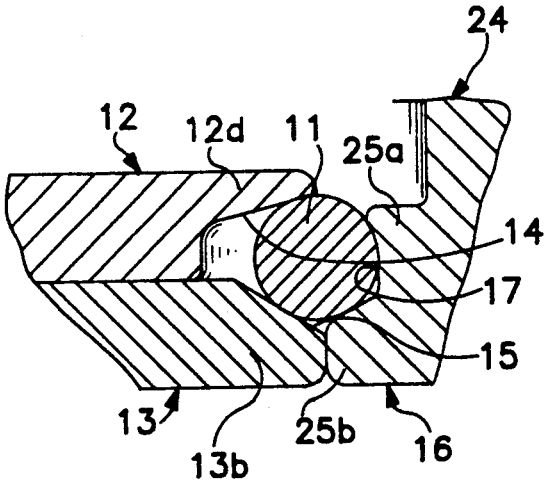
FIG. 3 is a fragmentary enlarged sectional view showing the engagement of a locking member with both an inwardly raised portion of a frame and holder members.

An inwardly raised portion 16 is formed over the lower inner peripheral edge of the sprinkler head body 1, which raised portion 16, as FIG. 3 shows, has an engagement face 17 formed on its inner surface for engagement by the locking member 11 as held between the holder members 12, 13, with inwardly projecting locking protrusions 25*a*, 25*b* formed on upper and lower sides relative to the engagement face 17. The inwardly raised portion 16 is diametrically larger than the holder members 12, 13.

A locking screw 18 is threadedly fitted in the internal threaded portion 12*c* of the holder member 12 and is generally centrally formed with a through-hole 18*a*. Reference numerals 20, 21, and 22 designate, respectively, a thermally insulative packing, a heat sensitive material, and heat meltable member which are interposed between a collar portion 18*b* formed at the lower end of the locking screw 18 and the lower end of the lower holder member 13. Shown by reference numeral 23 is a cap removably mounted for closing the through-hole 18*a* of the locking screw 18 to prevent entry of dust into the interior of the sprinkler head, and shown by 26 is a head cover fitted on the lower end of the frame 24.

The construction of the sprinkler head of the present embodiment having thus been described, the manner of using the sprinkler head will be explained.

Figure 4:
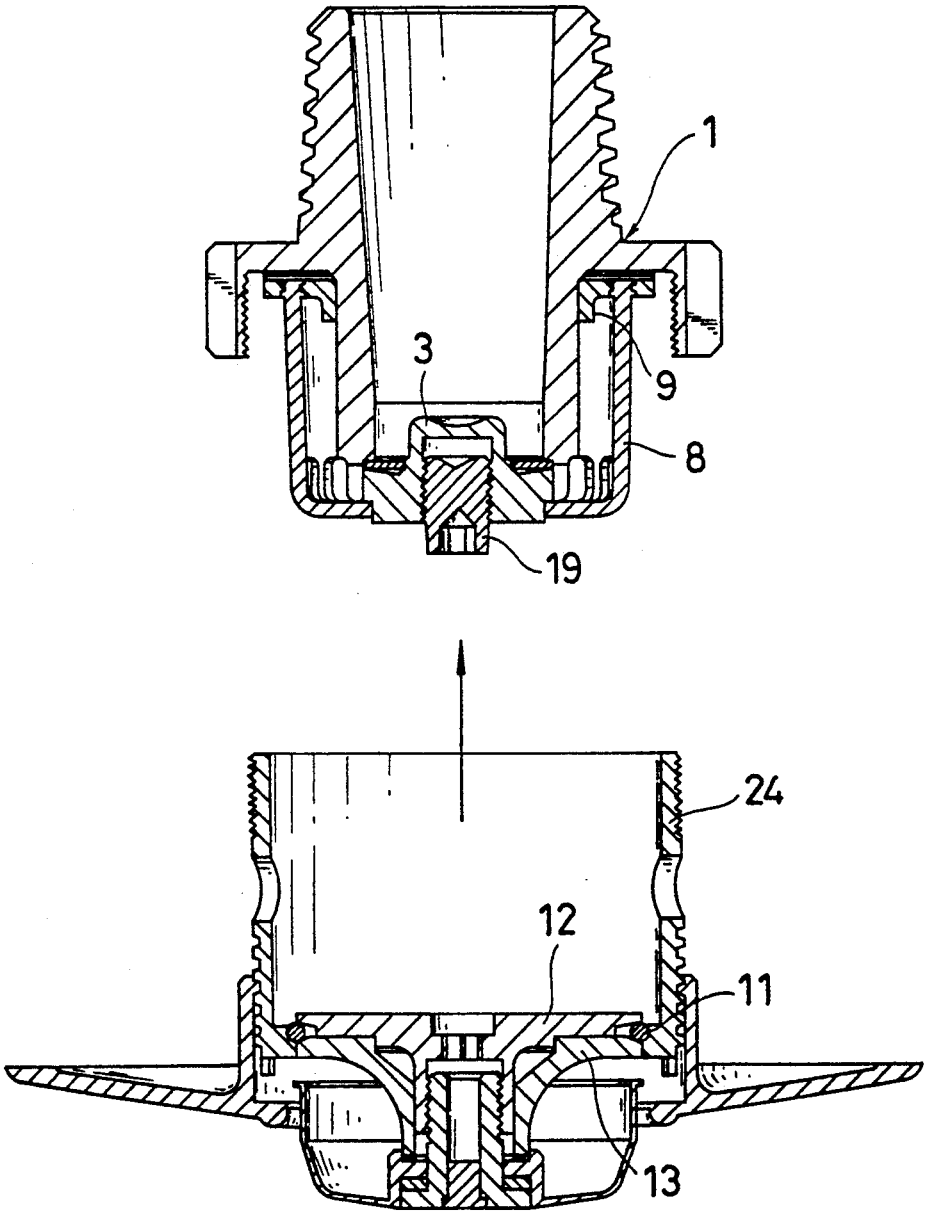
FIG. 4 is a sectional view showing by way of example a scene of sprinkler head assembly operation.

In order to assemble the sprinkler head, as FIG. 4 shows, the sprinkle head body 1, as one part, and the frame 24, as the other part, are separately assembled first, and then the two are assembled together by bringing them into thread engagement.

Figure 5A:
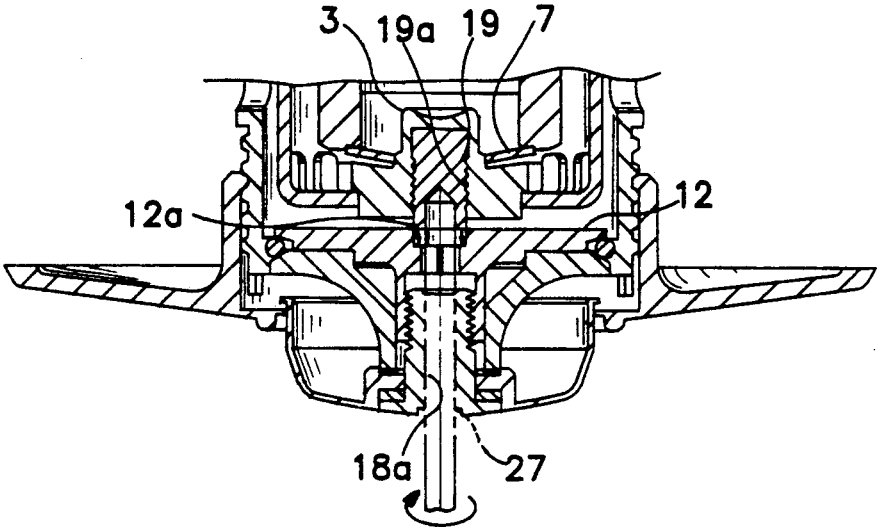
FIGS. 5 (*a*), 5 (*b*) are fragmentary enlarged views in section showing by way of example one aspect of sprinkler head assembly operation.
Figure 5B:
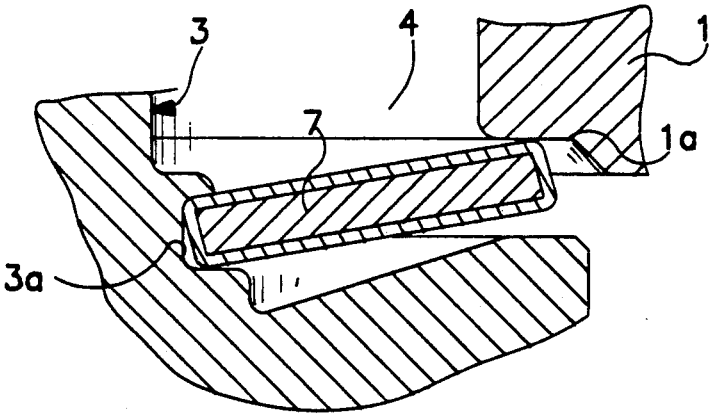

Subsequently, as FIG. 5 (*a*) shows, a hexagonal wrench 27 is inserted through the through-hole 18*a* of the locking screw 18 to fit in the hexagonal hole 19*a* of the in-press screw 19, and then turned, so that the in-press screw 19 is lowered until its lower end abuts the bottom of the hole 12*a* of the holder member 12. At this stage, the elastic member 7 is still in its stretched condition without being subject to any pressing force, as shown in FIG. 5 (*b*)

Figure 6A:
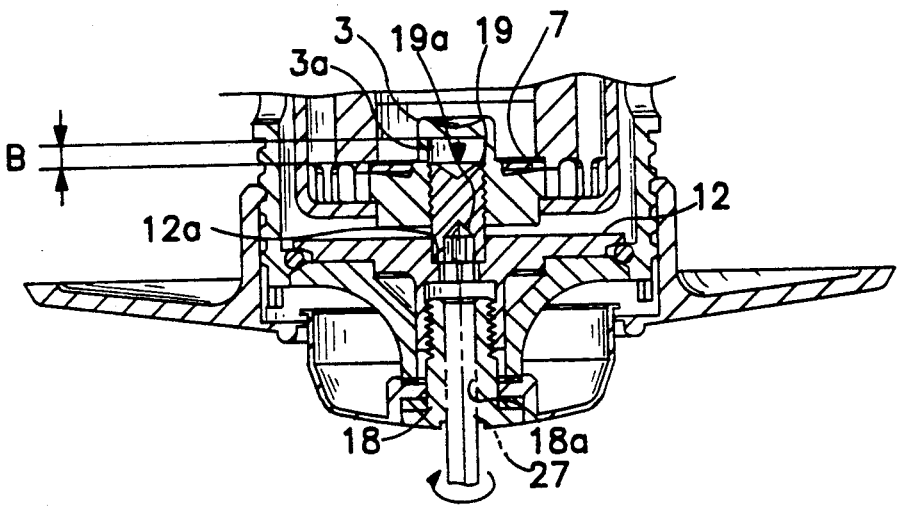
FIGS. 6 (*a*), 6 (*b*) are fragmentary enlarged views in section showing by way of example another aspect of sprinkler head assembly operation.
Figure 6B:
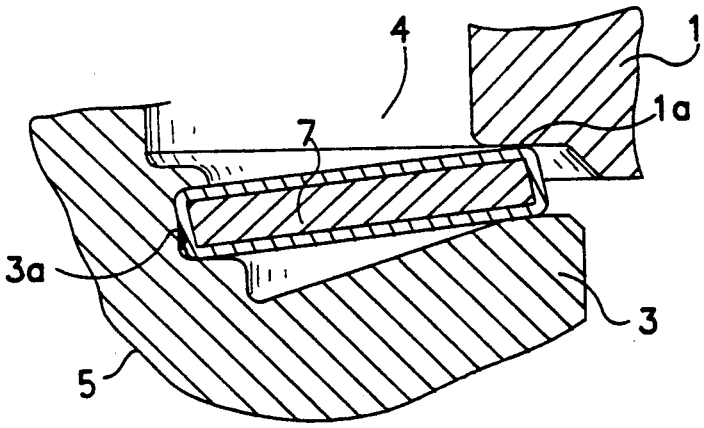

As the hexagonal wrench is further turned, conversely a pressing force is applied to the plug member 3 through the in-press screw 19 to shift the plug member 3 upward, as shown in FIG. 6(*a*), whereby the elastic member 7 is pressed between the upper surface of the collar portion 5 of the plug member 3 and the lower end 1*a* of the sprinkler head body 1 as shown in FIG. 6 (*b*). Thus, at the time when a clearance 3*a* of depth B is defined within the plug member 3, the outlet port 4 of the sprinkler head body 1, subjected to a pressing force corresponding to about 60% of the restoring force of the elastic member 7, is positively sealed by the plug member 3 through the fluoroplastic coated elastic member 7. Thereafter, the cap 23 is mounted over the through-hole 18*a* of the locking screw 18.

In this way, sprinkler head assembly operation can be done very easily, and yet the locking member 11 is accurately held in position by a combination of the holder members 12, 13 and the engagement face 17 of the frame 24. Thus, the required series of assembly operation can be performed without involving any complicated factor and can be even automated.

The pressing force applied by the plug member 3 against the elastic member 7 is adjustable through threaded shifting of the plug member 3. By suitably changing the screwed amount of the plug member 3, therefore, the elastic member 7 may be constantly subjected to an appropriate pressing force and, even if left in such condition for a long period of time, the resiliency of the elastic member 7 can be well maintained without being subject to any substantial deterioration.

The sprinkler head thus obtained is such that an engagement face 17 engageable by the locking member 11 is formed on the inner surface of the inwardly raised portion 16 of the frame 24 and locking protrusions 25*a*, 25*b* are formed on the upper and lower sides of the engagement face 17. Thus, by virtue of the engagement face 17, locking protrusions 25*a*, 25*b*, and the holder members 12, 13 in combination, the locking member 11 is firmly and accurately held in its locking position. Therefore, even if some external impact is applied to the lower end of the frame 24 during the process of assembly work or during the stage of sprinkler head mounting to the ceiling, there is no possiblity of the locking member 11 shifting that may lead to the trouble of the locking member 11 being relieved of its locking engagement.

Figure 7:
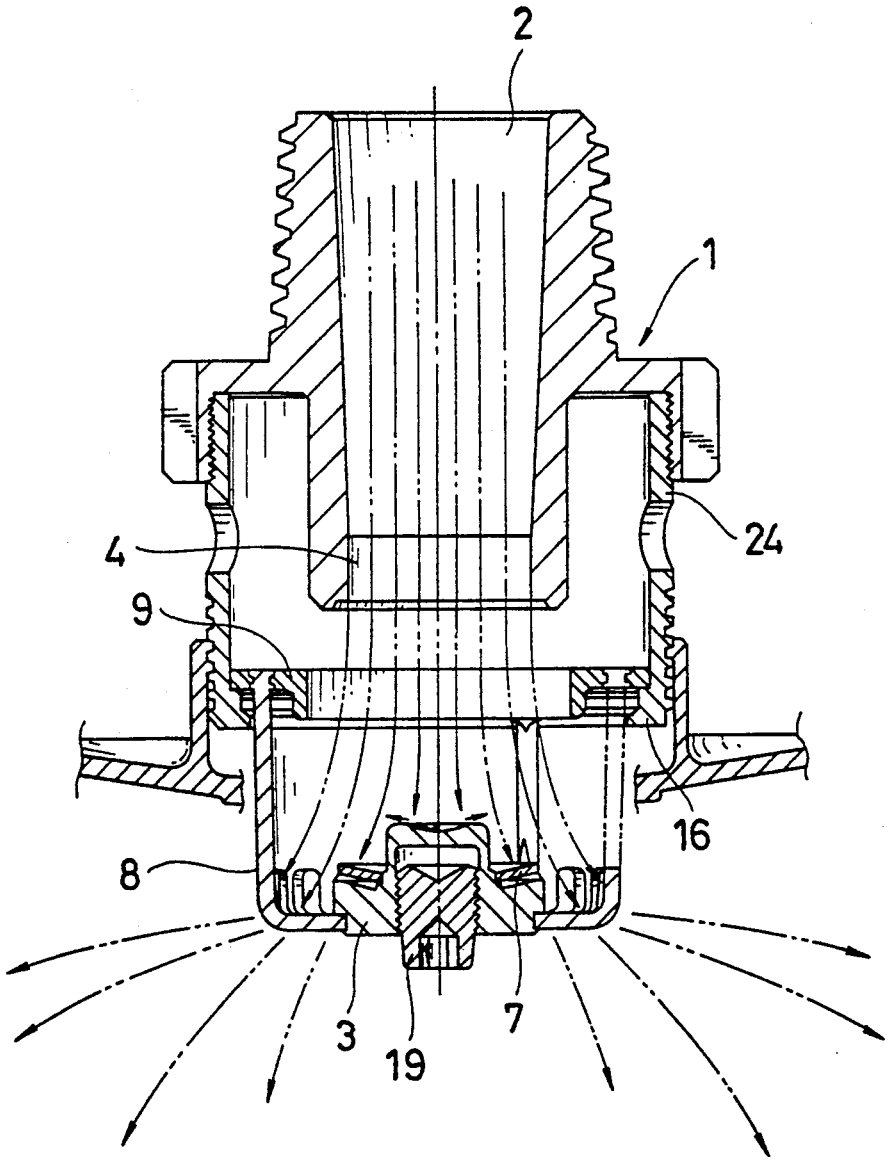
FIG. 7 is a sectional view showing a sprinkler head in operation.

In the event that a fire or the like should occur to cause a temperature rise with respect to the heat sensitive plate 21, the heat-meltable member 22 interposed between the heat-sensitive plate 21 and the lower end collar portion 18*b* of the locking screw 18 is melted or softened; therefore, as shown in FIG. 7, the lower holder member 13 is lowered and the locking member 11 is contracted to release the engagement between the engagement face 17 of the inwardly raised portion 16 of the frame 24 and the locking protrusions 25*a*, 25*b*, with the result that the holder members 12, 13, and the in-press screw 19, plug member 3, etc. supported by the holder members 12, 13 are allowed to drop downward of the sprinkler head body 1, the outlet port 4 being thus opened.

Since the plug member 3 is provided with a guide ring 9 having a guide portion 10 through the deflectors 8, when the plug member 3 drops, the guide portion 10 is guided in sliding relation with the outer periphery of the sprinkler head body 1, so that the plug member 3 is allowed to descend without involving any deflection and the guide ring 9 is stopped by the inwardly raised portion 16 of the frame 24 to cause the plug member 3 to stop descending.

By virtue of the elastic member 7 held taut between the lower end 1*a* of sprinkler head body 1 and the plug member 3, the descending of the plug member 3 can be accurately and speedily effected under the resiliency of the elastic member 7, the removal of the plug member 3 being thus greatly facilitated.

Fire-fighting water discharged from the outlet port 4 initially impinges upon the upper surface of the plug member 3 and then is spread in all directions for being radially sprinkled.

Figure 8:
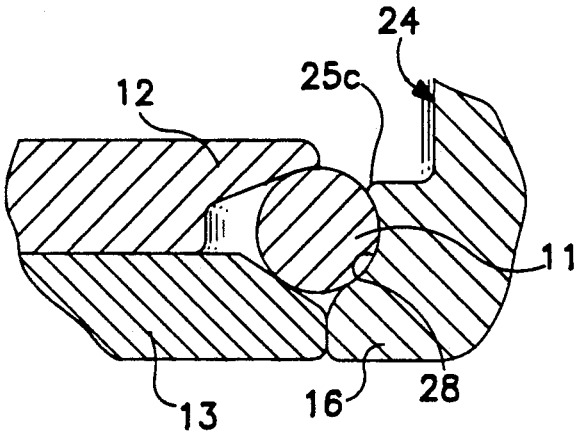
FIG. 8 is a fragmentary enlarged sectional view of another embodiment showing the engagement of a locking member with both an inwardly raised portion of a frame and holder members.
Figure 9:
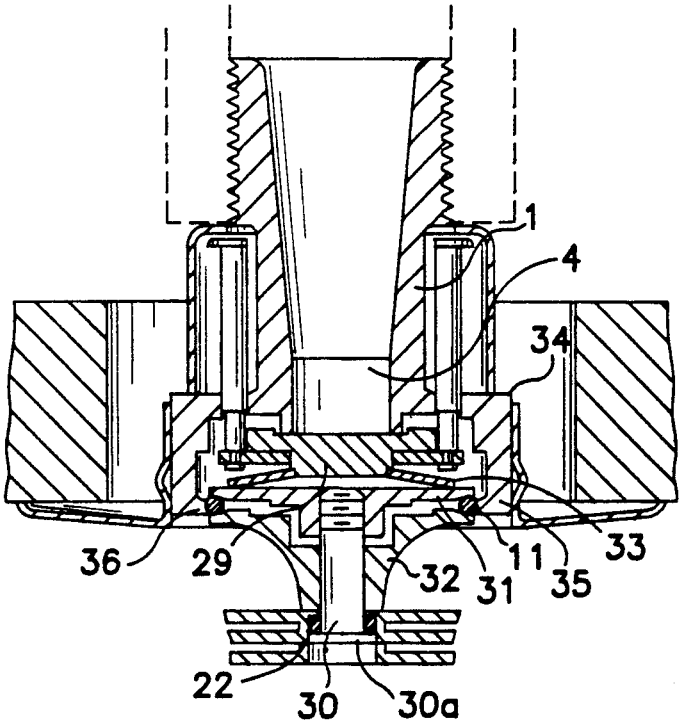
FIG. 9 (PRIOR ART)
FIG. 9 is a sectional view showing a prior art arrangement.

In the foregoing embodiment, the engagement face 17 and locking protrusions 25*a*, 25*b* are formed on the inner surface of the inwardly raised portion 16 of the frame 24. Alternatively, as FIG. 8 shows, a spherically concave portion 28 engageable by the locking member 11 may be formed in the inner surface of the inwardly raised portion 16, with a locking protrusion 25*c* being formed at a distal end of the recess 28 so as to prevent the dislocation of the locking member 11 from the recess 28.

In the embodiment, the elastic member comprises belleville springs coated with fluoroplastic on the surface thereof. It is understood, however, that the construction of the elastic member 7 is not particularly limited to the embodiment.

In the above embodiment, it is arranged that threaded engagement and disengagement of the in-press screw 19 with respect to the plug member 3 is effected by means of the hexagonal wrench 27. Alternatively, a driver or the like may be used instead.

Locking protrusions 25*a*, 25*b* formed on the inwardly raised portion 16 of the frame 24 need not necessarily be provided over the entire periphery of the inwardly raised portion 16, but may be provided in specified intervals.

The locking member 11 is not limited in configuration to the partially cutaway ring-shaped one as described above. Of course, a perfect ring-shaped (as shown in FIG. 10 (*b*)) one may be employed.

The means for dropping the holder members 12, 13, etc. when heat is sensed is not limited to the above described embodiment.

The invention being thus described, it will be obvious that the same may be varied in many ways. For example, the configuration of the plug member 3, holder members 12, 13, locking screw 18, in-press screw 19, etc. may be varied or changed in design within the intended scope of the invention.

What is claimed is:

1. A sprinkler head wherein a ring-shaped or partially cutaway ring-snaped expandable and contractible locking member is held in an expanded condition between collar portions of a pair of holder members, upper and lower, and an inwardly raised portion formed on a lower inner peripheral edge of a frame disposed in a body of the sprinkler head so that an outlet port of the sprinkler head body is closed by means of a plug member; and when a heat-meltiple member is melted or softened with heat, the locking member is contracted to permit the holder members to slip off the frame so as to release the plug member from the outlet port; the sprinkler head characterized in that said inwardly raised portion comprises a spherically concave portion formed on an inner surface thereof for engagement by said locking member, and a locking protrusion formed at one end of said spherically concave portion prevents disengagement of said locking member from said spherically concave portion.

2. A sprinkler head as set forth in claim 1, wherein an elastic member is interposed between a lower end portion of said sprinkler head body and said plug member, and a screw member is held in threaded engagement with an inner periphery of said plug member, so that by threadingly disengaging said screw member from said plug member, said plug memeber is allowed to shift toward the outlet port so that said elastic member is tensioned under a predetermined pressing force.

3. A sprinkler head as set forth in claim 2, wherein the pressing force applied to said elastic member is set at 60% of a restoring force of said elastic member.

4. A sprinkler head as set forth in claim 2, wherein a surface of said elastic member is coated with fluoroplastic.

5. A sprinkler head as set forth in claim 2, wherein said elastic member consists of belleville springs.

6. A sprinkler head as set forth in claim 2, wherein an outer periphery of said plug member is formed with a recessed groove for engagement with an inner periphery of said elastic member.

* * * * *